US009453669B2

(12) United States Patent
Milton et al.

(10) Patent No.: US 9,453,669 B2
(45) Date of Patent: Sep. 27, 2016

(54) METHOD OF CONTROLLING INLET PRESSURE OF A REFRIGERANT COMPRESSOR

(75) Inventors: Scott C. Milton, Maplewood, MN (US); Stan O. Hoium, West St. Paul, MN (US); Peter W. Freund, Bloomington, MN (US); Bradley M. Ludwig, Minnetonka, MN (US)

(73) Assignee: THERMO KING CORPORATION, Minneapolis, MN (US)

( * ) Notice: Subject to any disclaimer, the term of this patent is extended or adjusted under 35 U.S.C. 154(b) by 1323 days.

(21) Appl. No.: 12/958,675

(22) Filed: Dec. 2, 2010

(65) Prior Publication Data

US 2011/0132006 A1 Jun. 9, 2011

Related U.S. Application Data

(60) Provisional application No. 61/267,579, filed on Dec. 8, 2009.

(51) Int. Cl.
*F25B 41/00* (2006.01)
*F25B 49/00* (2006.01)
(Continued)

(52) U.S. Cl.
CPC ..... *F25B 47/006* (2013.01); *F25B 41/04* (2013.01); *F25B 2327/001* (2013.01);
(Continued)

(58) Field of Classification Search
CPC .... F25B 49/022; F25B 49/025; F25B 41/04; F25B 49/027; F25B 31/008; F25B 41/062; F25B 1/00; F25B 13/00; F25B 2400/0406; F25B 2400/0411; F25B 2700/1933; B60H 1/322; B60H 1/3222; B60H 1/00385; B60H 1/004; B60H 41/062; B60H 49/027; B60H 31/008
USPC ..... 62/196.4, 196.1, 197, 115, 498, 323.3
See application file for complete search history.

(56) References Cited

U.S. PATENT DOCUMENTS 3,243,970 A * 4/1966 Lippincott ..... 62/197
3,638,446 A 2/1972 Palmer
(Continued)

FOREIGN PATENT DOCUMENTS

EP 1832451 9/2007
JP 2007112357 5/2007
(Continued)

OTHER PUBLICATIONS

PCT/US2010/058895 International Search Report and Written Opinion, dated Aug. 26, 2011.
(Continued)

*Primary Examiner* — M. Alexandra Elve
*Assistant Examiner* — Daniel C Comings
(74) *Attorney, Agent, or Firm* — Hamre, Schumann, Mueller & Larson, P.C.

(57) ABSTRACT

A refrigeration unit includes an engine, a motor capable of producing a similar power output as the engine, and a compressor driven by one of the engine and the motor. The compressor includes a suction inlet and a discharge outlet. The refrigeration unit also includes a condenser in fluid communication with the discharge outlet through which pressurized, gaseous refrigerant is condensed, an evaporator in fluid communication with the condenser to receive liquid refrigerant and return gaseous refrigerant to the suction inlet, a passageway having a first end in fluid communication with an outlet of the condenser, and a second end in fluid communication with the suction inlet, and a purge valve defining at least a portion of the passageway between the first and second ends. The purge valve is operable to selectively divert liquid refrigerant from the condenser to the suction inlet to increase the pressure in the suction inlet.

30 Claims, 4 Drawing Sheets

(51) Int. Cl.
*F25B 47/00* (2006.01)
*F25B 41/04* (2006.01)

(52) U.S. Cl.
CPC ..... *F25B 2400/0403* (2013.01); *F25B 2400/0409* (2013.01); *F25B 2400/0411* (2013.01); *F25B 2600/0261* (2013.01); *F25B 2600/2501* (2013.01); *F25B 2700/1933* (2013.01)

(56) References Cited

U.S. PATENT DOCUMENTS

| | | | | |
|---|---|---|---|---|
| 3,766,748 | A | 10/1973 | Bottum et al. | |
| 3,828,569 | A | 8/1974 | Weisgerber | |
| 4,102,150 | A | 7/1978 | Kountz | |
| 4,132,086 | A | 1/1979 | Kountz | |
| 4,258,553 | A * | 3/1981 | Kelly et al. | 62/117 |
| 4,384,608 | A | 5/1983 | Scarlett et al. | |
| 4,481,784 | A | 11/1984 | Elmslie | |
| 4,962,648 | A * | 10/1990 | Takizawa | F25B 5/02 62/199 |
| 5,150,584 | A | 9/1992 | Tomasov et al. | |
| 5,408,841 | A * | 4/1995 | Fujiwara | B60H 1/3225 62/192 |
| 5,946,925 | A | 9/1999 | Williams et al. | |
| 6,105,666 | A * | 8/2000 | Tajima et al. | 165/202 |
| 6,237,681 | B1 * | 5/2001 | Takano et al. | 165/241 |
| 6,321,550 | B1 | 11/2001 | Chopko et al. | |
| 6,615,598 | B1 | 9/2003 | Wang et al. | |
| 6,910,341 | B2 * | 6/2005 | Srichai | B60H 1/00914 62/115 |
| 7,353,660 | B2 | 4/2008 | Lifson et al. | |
| 7,412,841 | B2 | 8/2008 | Ueda et al. | |
| 2002/0174665 | A1 | 11/2002 | Pritchard et al. | |
| 2008/0314059 | A1 | 12/2008 | Harkness et al. | |
| 2008/0319587 | A1 * | 12/2008 | Cowans | F25B 41/00 700/299 |
| 2010/0011793 | A1 | 1/2010 | Tiranno et al. | |
| 2010/0115975 | A1 * | 5/2010 | Mitra et al. | 62/196.1 |

FOREIGN PATENT DOCUMENTS

| | | |
|---|---|---|
| KR | 1020090083543 | 8/2009 |
| WO | 00/42366 | 7/2000 |

OTHER PUBLICATIONS

Supplementary Partial European Search Report for European Application No. 10836453, mailed Aug. 14, 2014, 8 pgs.

* cited by examiner

METHOD OF CONTROLLING INLET PRESSURE OF A REFRIGERANT COMPRESSOR

CROSS-REFERENCE TO RELATED APPLICATIONS

This application claims priority to U.S. Provisional Patent Application No. 61/267,579 filed on Dec. 8, 2009, the entire content of which is incorporated herein by reference.

FIELD OF THE INVENTION

The present invention relates to refrigeration units, and more particularly to refrigeration units for use with refrigerated containers or trailers.

BACKGROUND OF THE INVENTION

Refrigeration units incorporated in refrigerated trailers typically employ both an engine and an electric motor as separate power sources that may be used to drive a compressor in the refrigeration unit. The engine (e.g., a diesel engine) is typically sized having a power output sufficient to meet the temperature pull-down requirements of a particular trailer, while the electric motor is typically sized having a power output sufficient to operate the unit to maintain a particular temperature in the trailer. The power output of the motor is often less than the power output capability of the engine.

Typical electric motors utilized in refrigerated trailer refrigeration units do not have enough power (e.g., 14 hp) to operate the individual components of the unit (e.g., the compressor, an alternator, and fans) at the same speeds, when the unit is operating at a relatively high load, that otherwise are available when the engine is providing power to the system (i.e., when the unit is operating in the high-speed mode with power from the diesel engine). Larger electric motors having higher power outputs and variable-speed capability, which otherwise would be a functional equivalent to the diesel engine in both power output and variable speed operation, are often not used in refrigerated trailer refrigeration units because their size often exceeds the spatial constraints within the refrigeration unit.

SUMMARY OF THE INVENTION

The present invention provides, in one aspect, a refrigeration unit including an engine, an electric motor capable of producing a similar power output as the engine, and a compressor driven by one of the engine and the motor. The compressor includes a suction inlet and a discharge outlet. The refrigeration unit also includes a condenser in fluid communication with the discharge outlet through which pressurized, gaseous refrigerant is condensed, an evaporator in fluid communication with the condenser to receive liquid refrigerant therefrom and return heated, gaseous refrigerant to the suction inlet, a passageway having a first end in fluid communication with an outlet of the condenser, and a second end in fluid communication with the suction inlet, and a purge valve defining at least a portion of the passageway between the first and second ends. The purge valve is operable to selectively divert liquid refrigerant from the condenser to the suction inlet to increase the pressure in the suction inlet.

The present invention provides, in another aspect, a refrigeration unit including a prime mover and a compressor driven by the prime mover. The compressor includes a suction inlet and a discharge outlet. The refrigeration unit also includes a condenser in fluid communication with the discharge outlet through which pressurized, gaseous refrigerant is condensed, an evaporator in fluid communication with the condenser to receive liquid refrigerant therefrom and return heated, gaseous refrigerant to the suction inlet, and a purge valve positioned between an outlet of the condenser and the suction inlet. The purge valve is operable to selectively divert liquid refrigerant from the condenser to the suction inlet to increase the pressure of the refrigerant in the suction inlet. The refrigeration unit further includes a hot gas bypass valve positioned between the discharge outlet and the suction inlet. The hot gas bypass valve is operable to selectively divert pressurized, gaseous refrigerant from the discharge outlet to the suction inlet to increase the temperature of the refrigerant in the suction inlet.

The present invention provides, in yet another aspect, a method of controlling pressure in a suction inlet of a compressor for a refrigeration unit. The method includes driving the compressor with a prime mover, fluidly communicating a discharge outlet of the compressor with a condenser in which pressurized, gaseous refrigerant is condensed into a liquid, returning heated, gaseous refrigerant to the suction inlet from an evaporator, providing a passageway having a first end in fluid communication with an outlet of the condenser, and a second end in fluid communication with the suction inlet, detecting the pressure in the suction inlet, and selectively diverting liquid refrigerant from the condenser to the suction inlet, through the passageway, in response to the detected pressure in the suction inlet to increase the pressure in the suction inlet.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
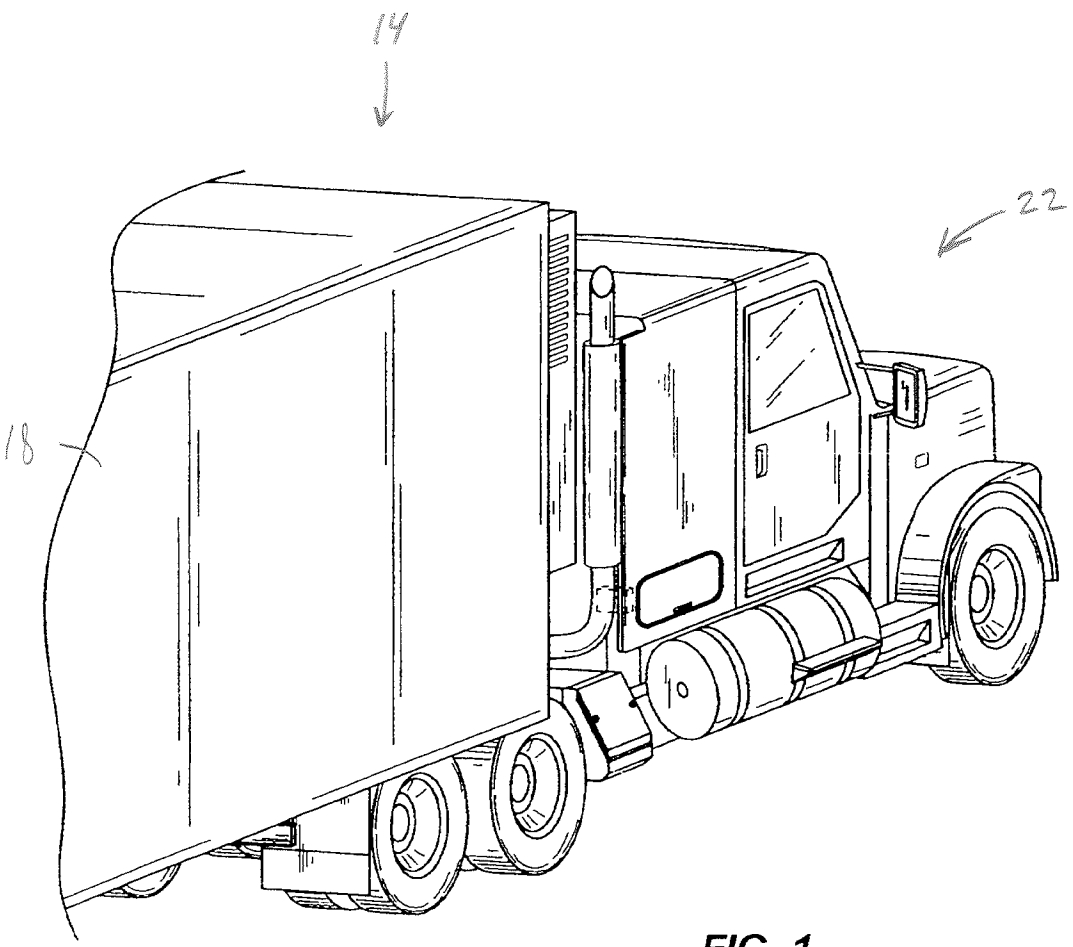
FIG. 1 is a perspective view of a refrigerated trailer in which a refrigeration unit of the present invention may be incorporated.
Figure 2:
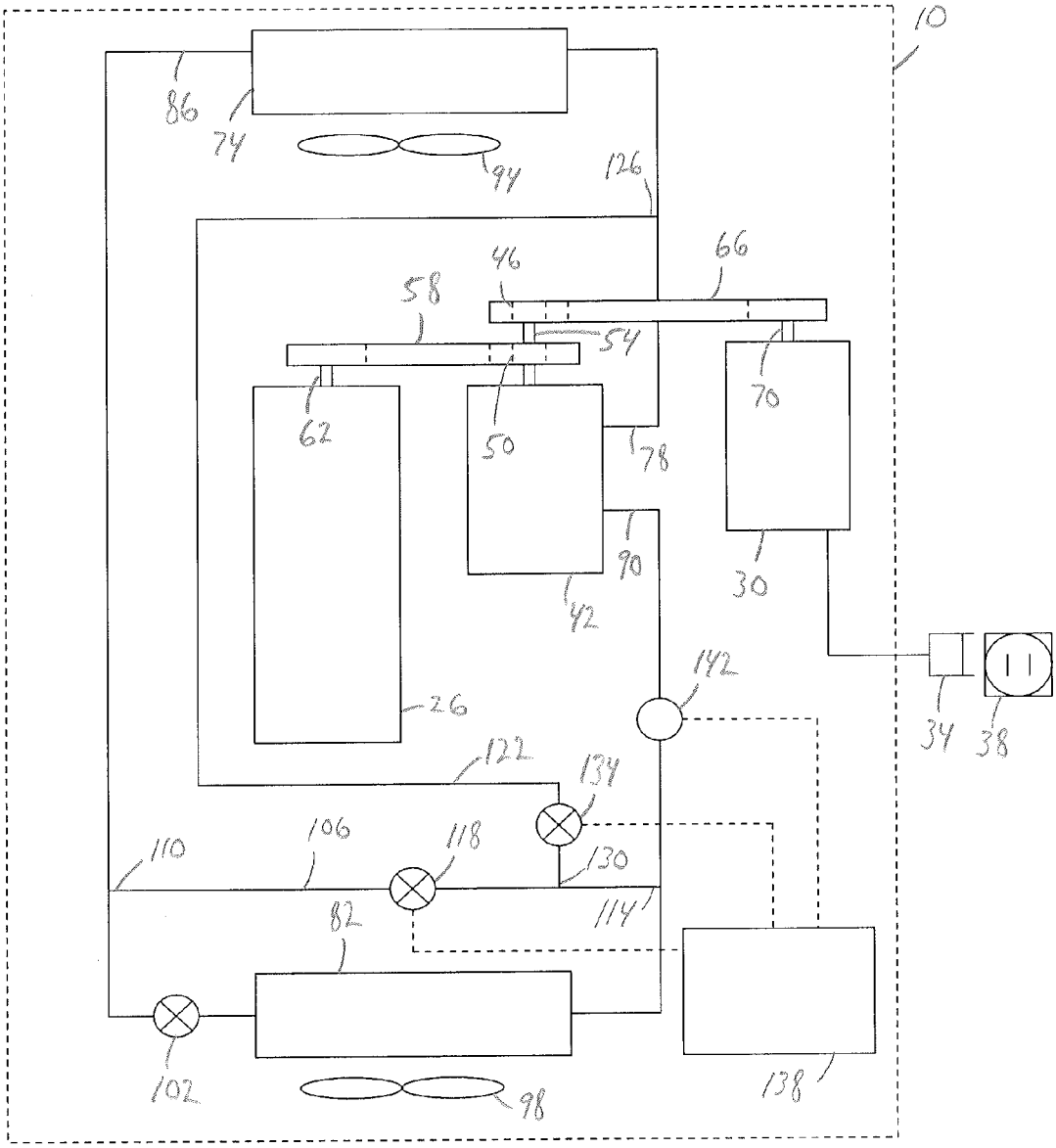
FIG. 2 is a schematic illustrating the refrigeration unit of the present invention.

FIG. 2 illustrates a refrigeration unit 10 for use with a refrigerated cargo-carrying container 14 (e.g., a refrigerated trailer 18 connected to a semi-truck 22; see FIG. 1). Alternatively, the container 14 may be configured for other modes of transportation (e.g., by railroad, ship, or airline). With reference to FIG. 2, the refrigeration unit 10 includes separate prime movers in the form of a diesel engine 26 and a single-speed electric motor 30 capable of producing a similar power output as the diesel engine 26 (e.g., 24 hp). In the illustrated construction of the refrigeration unit 10, the electric motor 30 is connectable to a remote power source by an electrical plug 34. For example, the plug 34 may be connected to an outlet 38 while the container 14 is sitting in a loading dock. Alternatively, the refrigeration unit 10 may include an on-board power source to power the electric motor 30 (e.g., a battery, fuel cell, etc.).

The refrigeration unit 10 also includes a compressor 42 driven by one of the engine 26 and the motor 30. In the illustrated construction of the refrigeration unit 10, the compressor 42 includes a sprag or overrunning clutch 46 and an electromagnetic clutch 50 coupled coaxially to an input shaft 54 of the compressor 42. A first endless drive member 58 (e.g., a belt, chain, etc.) interconnects an output shaft 62 of the engine 26 and the electromagnetic clutch 50, while a second endless drive member 66 interconnects an output shaft 70 of the motor 30 and the overrunning clutch 46. The arrangement of the clutches 46, 50 on the input shaft 54 of the compressor 42 permits the compressor 42 to be driven by only one of the engine 26 and the motor 30 at any given time. An additional discussion of this arrangement and the operation thereof is disclosed in U.S. Publication No. 2008/0314059, the entire content of which is hereby incorporated by reference. Alternatively, the compressor 42 may be drivably coupled to the engine 26 and the motor 30 in any of a number of different ways to accommodate driving the compressor 42 with only one of the engine 26 and the motor 30 at any given time.

With continued reference to FIG. 2, the refrigeration unit 10 includes a condenser 74 in fluid communication with a discharge outlet 78 of the compressor 42 through which pressurized, gaseous refrigerant is condensed into a liquid. The refrigeration unit 10 also includes an evaporator 82 in fluid communication with an outlet 86 of the condenser 74 to receive liquid refrigerant therefrom and return heated, gaseous refrigerant to a suction inlet 90 of the compressor 42. In the illustrated construction of the refrigeration unit 10, respective fans 94, 98 are utilized with the condenser 74 and the evaporator 82 to increase the flow rate of airflow moving through the condenser 74 and evaporator 82, respectively, and therefore the overall efficiency of the refrigeration unit 10. Alternatively, the fans 94, 98 may be omitted. The refrigeration unit 10 also includes an expansion valve 102 positioned immediately upstream of the evaporator 82 to meter the flow rate of liquid refrigerant entering the evaporator 82 in a conventional manner.

The refrigeration unit 10 further includes a first passageway 106 having a first end 110 in fluid communication with the outlet 86 of the condenser 74, and a second end 114 in fluid communication with the suction inlet 90, and a purge valve 118 defining at least a portion of the passageway 106 between the first and second ends 110, 114. The purge valve 118 may be positioned inline with the first passageway 106 in any of a number of different ways. As is discussed in detail below, the purge valve 118 is operable to selectively divert liquid refrigerant from the condenser 74 to the suction inlet 90 to increase the pressure in the suction inlet 90.

The refrigeration unit 10 also includes a second passageway 122 having a first end 126 in fluid communication with the discharge outlet 78, and a second end 130 in fluid communication with the suction inlet 90 (via the first passageway 106), and a hot gas bypass valve 134 defining at least a portion of the second passageway 122 between the first and second ends 126, 130. Like the purge valve 118, the hot gas bypass valve 134 may be positioned inline with the second passageway 122 in any of a number of different ways. Although the second end 130 is shown connected to the first passageway 106, the second end of the second passageway 122 may alternatively be directly connected to the suction inlet 90. As is discussed in detail below, the hot gas bypass valve 134 is operable to selectively divert pressurized, gaseous refrigerant from the discharge outlet 78 to the suction inlet 90 to increase the temperature of the refrigerant in the suction inlet 90.

With continued reference to FIG. 2, the refrigeration unit 10 further includes a controller 138 in communication with the purge valve 118 and the hot gas bypass valve 134 (e.g., using wires or a wireless communication protocol). As is discussed in detail below, the controller 138 is operable to separately adjust (i.e., open and close) the purge valve 118 and the hot gas bypass valve 134 to adjust the flow rate of liquid refrigerant through the first passageway 106 and the flow rate of pressurized, gaseous refrigerant through the second passageway 122, respectively. The refrigeration unit 10 also includes a pressure sensor 142 in fluid communication with the suction inlet 90 to detect the pressure in the suction inlet 90. The controller 138 is in communication with the pressure sensor 142 (e.g., using wires or a wireless communication protocol) to monitor the pressure in the suction inlet 90. The controller 138 is operable to modulate at least one of the purge valve 118 and the hot gas bypass valve 134 in response to the detected pressure in the suction inlet 90.

In operation, the refrigeration unit 10 may use either the diesel engine 26 or the electric motor 30 to drive the compressor 42 to initially reduce or "pull down" the temperature in the refrigerated container 14 to a desired refrigeration temperature in accordance with the particular cargo being transported. When the temperature in the refrigerated container 14 reaches the desired refrigeration temperature, the loading of the refrigeration unit 10 may be reduced by throttling the diesel engine 26 to a lower speed when the engine 26 is used to drive the compressor 42. Consequently, the flow rate of refrigerant throughout the unit 10 may be reduced. However, when using the electric motor 30 to drive the compressor 42, the single-speed electric motor 30 cannot throttle to a lower speed and will continue to operate the compressor 42 at a speed that is higher than necessary for the particular load on the unit 10. This, in turn, causes the compressor 42 to pull a relatively large vacuum in the suction inlet 90. Extended periods of operating the compressor 42 at a relatively large vacuum in the suction inlet 90 may shorten the useful life of the compressor 42.

The pressure in the suction inlet 90 may be increased, however, by increasing the mass flow rate of refrigerant through the suction inlet 90. In the present invention, this is accomplished by injecting liquid refrigerant into the suction inlet 90 of the compressor 42, at a location downstream of the evaporator 82. Particularly, in response to detection of an undesirable vacuum level in the suction inlet 90 by the pressure sensor 142, the controller 138 actuates the purge valve 118 to divert some of the liquid refrigerant from the outlet 86 of the condenser 74 through the first passageway 106 and into the suction inlet 90. The actuation of the purge valve 118 is modulated by the controller 138 to provide a controlled injection of the liquid refrigerant into the suction inlet 90. The controller 138 may modulate the actuation of the purge valve 118 to divert a sufficient amount of liquid refrigerant through the first passageway 106 and into the suction inlet 90 to increase the pressure in the suction inlet 90 to an acceptable level. The hot gas bypass valve 134 may remain closed during actuation of the purge valve 118.

When liquid refrigerant is injected into the suction inlet 90 by the purge valve 118, due to the differences in temperature and pressure of the injected liquid refrigerant and the heated, gaseous refrigerant being returned in the suction inlet 90, the liquid refrigerant may quickly expand and evaporate (i.e., "flash off"). When this occurs, the suction inlet 90 of the compressor 42 is cooled, potentially forming ice or frost on the suction inlet 90 and/or the refrigerant line interconnecting the compressor 42 and the evaporator 82. Such ice or frost may effectively insulate the suction inlet 90, thereby lowering the temperature of the suction inlet 90 below the flash point of the refrigerant, potentially allowing liquid refrigerant to reach the compressor 42 and negatively affect its operation (e.g., by causing "slugging"). This concern is substantially alleviated by modulating the purge valve 118.

In other embodiments, the concern of frost buildup on the suction inlet 90 may also be addressed by actuating the hot gas bypass valve 134 to mix heated, compressed gaseous refrigerant with the cooled, liquid refrigerant entering the suction inlet 90 that was diverted through the purge valve 118. The gaseous refrigerant is cooled and condensed by the liquid refrigerant with which it is mixed. As a result, the additional liquid refrigerant injected into the suction inlet 90 has a temperature greater than that of the cooled liquid refrigerant from the condenser 74 alone. The controller 138 may modulate the actuation of the hot gas bypass valve 134 to divert a sufficient amount of heated, compressed gaseous refrigerant through the second passageway 122 and into the suction inlet 90 to increase the temperature of the refrigerant in the suction inlet 90 to substantially reduce or eliminate the formation of ice or frost on the suction inlet 90 and/or the refrigerant line interconnecting the evaporator 82 and the compressor 42 when the purge valve 118 is actuated to inject cooled, liquid refrigerant into the suction inlet 90.

In operation of the refrigeration unit 10, the controller 138 may modulate the purge valve 118 and the hot gas return valve 134 in effort to reach a balance where enough cooled, liquid refrigerant is injected into the suction inlet 90 to reduce the vacuum in the suction inlet 90, while substantially preventing or reducing the formation of ice or frost on the suction inlet 90, and subsequent slugging of the compressor 42.

Figure 3:
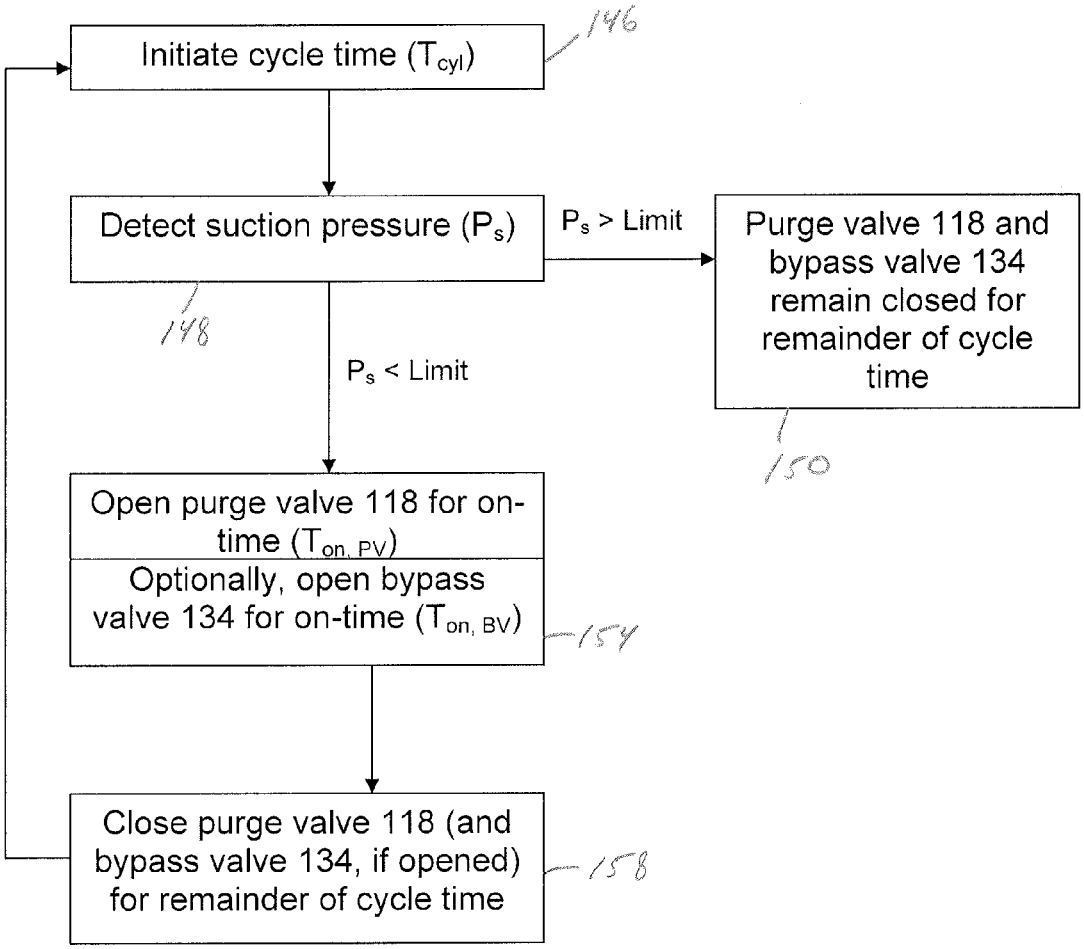
FIG. 3 is a flow chart illustrating a process for controlling the suction pressure in a compressor of the refrigeration unit of FIG. 2

FIG. 3 illustrates a process for monitoring the pressure in the suction inlet 90 and injecting additional cooled, liquid refrigerant into the suction inlet 90 to increase the pressure (i.e., reduce the vacuum) in the suction inlet 90. The process is initiated at step 146 in which the cycle time ($T_{cyl}$) for the process is initiated. The cycle time may have the following values: a default of 6 seconds, a minimum of 1 second, a maximum of 120 seconds, and a resolution of 0.1 seconds. After the cycle time is initiated, the pressure ($P_s$) in the suction inlet 90 is detected at step 148. If the suction pressure is equal to or greater than a predetermined limit (default is 0 psig), the purge valve 118 and hot gas bypass valve 134 remain closed at step 150 for the remainder of the cycle time. While in the cycle time loop, the suction pressure will not be checked again, and if the operation of the unit 10 is changed to a mode in which this feature does not apply, the outputs will be de-energized, the timers cleared, and this routine will be exited. If, however, the suction pressure is less than a predetermined limit (default is 0 psig), then the purge valve 118 (and optionally the hot gas bypass valve 134) are opened at step 154. The purge valve 118 may open for an on-time ($T_{on,\ PV}$) having the following values: a default of 0.4 seconds, a minimum of 0 seconds, a maximum of 30.0 seconds, and a resolution of 0.1 seconds. After the on-time has expired, the purge valve 118 is closed at step 158 and remains closed for the remainder of the cycle time. When the hot gas bypass valve 134 is modulated with the purge valve 118, the on-time settings ($T_{on,\ BV}$) of the bypass valve 134 include: a default 5.9 seconds, a minimum of 0 seconds, a maximum of 30.0 seconds, and a resolution of 0.1 seconds. At the conclusion of the cycle time, the cycle is reinitiated at step 146.

Figure 4:
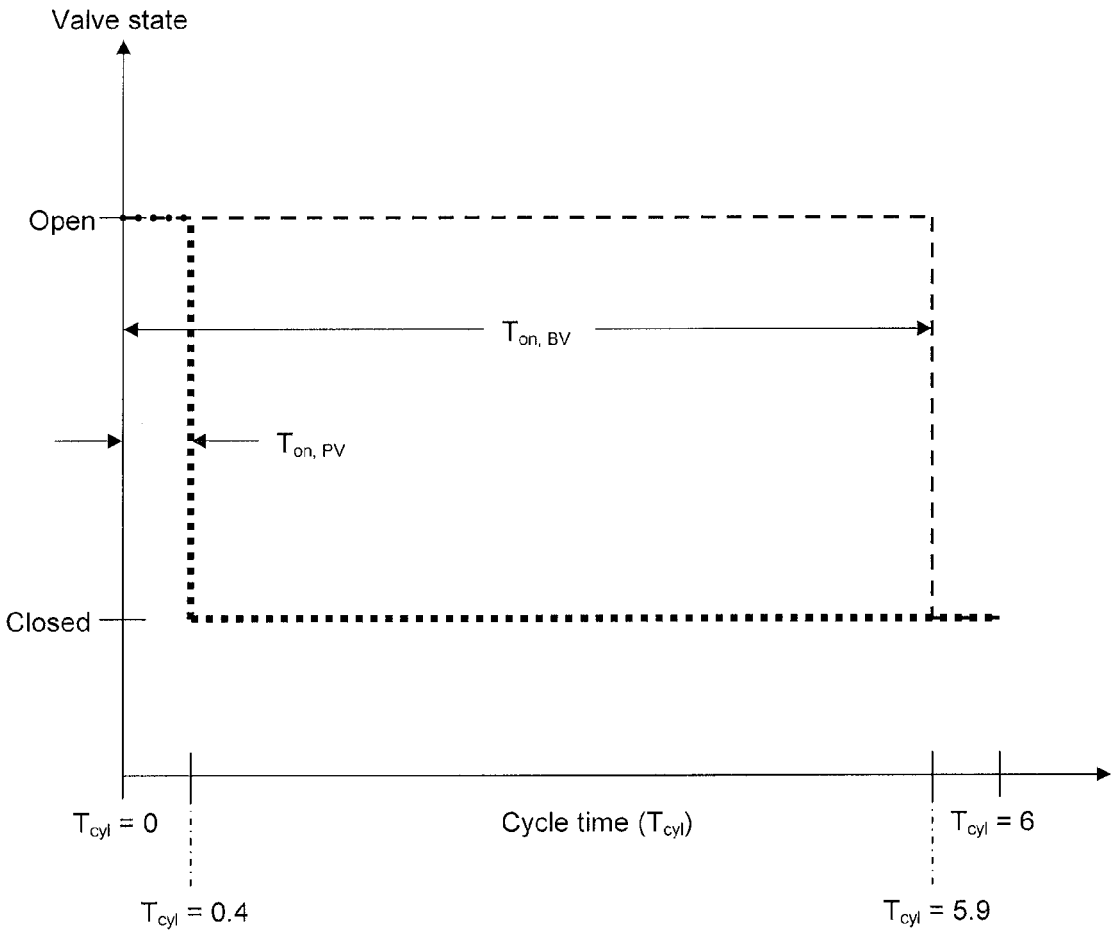
FIG. 4 is a graph illustrating the actuation of a purge valve and a hot gas bypass valve of the refrigeration unit of FIG. 2.

FIG. 4 is a graphical representation of the opening and closing of the valves 118, 134 using the default values described above for the duration of each on-time, presuming that the detected suction pressure is less than the predetermined limit to cause the actuation of the valves 118, 134. It should be understood that the respective on-times for the valves 118, 134 could be varied or adjusted between cycles depending upon the magnitude of the detected suction pressure.

Various features of the invention are set forth in the following claims.

What is claimed is:

1. A refrigeration unit comprising:

an engine;

an electric motor capable of producing the same power output as the engine;

a compressor driven by one of the engine and the motor, the compressor including a suction inlet and a discharge outlet;

a condenser in fluid communication with the discharge outlet through which pressurized, gaseous refrigerant is condensed;

an evaporator in fluid communication with the condenser to receive liquid refrigerant from the condenser and return heated, gaseous refrigerant to the suction inlet;

a passageway having a first end in fluid communication with an outlet of the condenser, and a second end in fluid communication with the suction inlet, wherein the passageway directs liquid refrigerant directly from the outlet of the condenser to the suction inlet in a liquid phase;

a purge valve defining at least a portion of the passageway between the first and second ends, the purge valve operable to selectively divert the liquid refrigerant from the condenser to the suction inlet to increase a pressure in the suction inlet; and a controller configured to open the purge valve to deliver liquid refrigerant exiting the outlet of the condenser to the suction inlet in the liquid phase when the pressure in the suction inlet is less than a predetermined limit to increase the pressure in the suction inlet.

2. The refrigeration unit of claim 1, wherein the passageway is a first passageway, and wherein the refrigeration unit further includes a second passageway having a first end in fluid communication with the discharge outlet, and a second end in fluid communication with the suction inlet, and a hot gas bypass valve defining at least a portion of the second passageway between the first and second ends of the second passageway.

3. The refrigeration unit of claim 2, wherein the hot gas bypass valve is operable to selectively divert the pressurized, gaseous refrigerant from the discharge outlet to the suction inlet to increase a temperature of the refrigerant in the suction inlet.

4. The refrigeration unit of claim 3, wherein the controller is operable to open and close the hot gas bypass valve to adjust a flow rate of the pressurized, gaseous refrigerant through the second passageway.

5. The refrigeration unit of claim 4, wherein the controller is operable to modulate the hot gas bypass valve.

6. The refrigeration unit of claim 4, wherein the controller is operable to open and close the purge valve to adjust a flow rate of the liquid refrigerant through the first passageway.

7. The refrigeration unit of claim 6, further comprising a pressure sensor in fluid communication with the suction inlet to detect the pressure in the suction inlet.

8. The refrigeration unit of claim 7, wherein the controller is in communication with the pressure sensor to monitor the pressure in the suction inlet, and wherein the controller is operable to adjust at least one of the purge valve and the hot gas bypass valve in response to the monitored pressure in the suction inlet.

9. The refrigeration unit of claim 6, wherein the controller is operable to modulate the purge valve.

10. The refrigeration unit of claim 2, wherein the controller is configured to open the hot gas bypass valve when the pressure in the suction inlet is less than the predetermined limit.

11. The refrigeration unit of claim 1, wherein the controller is operable to open and close the purge valve to adjust a flow rate of the liquid refrigerant through the passageway.

12. The refrigeration unit of claim 11, wherein the controller is operable to modulate the purge valve.

13. The refrigeration unit of claim 1, wherein the purge valve is operable to selectively divert the liquid refrigerant from the condenser to the suction inlet when the compressor is driven by the motor.

14. A refrigeration unit comprising:

a compressor including a suction inlet and a discharge outlet;

a condenser in fluid communication with the discharge outlet through which pressurized, gaseous refrigerant is condensed;

an evaporator in fluid communication with the condenser to receive liquid refrigerant from the condenser and return heated, gaseous refrigerant to the suction inlet;

a purge valve positioned between an outlet of the condenser and the suction inlet, and operable to selectively divert the liquid refrigerant directly from the condenser to the suction inlet in a liquid phase to increase a pressure of the refrigerant in the suction inlet;

a hot gas bypass valve positioned between the discharge outlet and the suction inlet, and operable to selectively divert the pressurized, gaseous refrigerant from the discharge outlet to the suction inlet to increase a temperature of the refrigerant in the suction inlet; and a controller configured to open the purge valve when the pressure in the suction inlet is less than a predetermined limit to increase the pressure in the suction inlet.

15. The refrigeration unit of claim 14, further comprising a first passageway having a first end in fluid communication with the outlet of the condenser, and a second end in fluid communication with the suction inlet, wherein the purge valve defines at least a portion of the first passageway between the first and second ends.

16. The refrigeration unit of claim 15, further comprising a second passageway having a first end in fluid communication with the discharge outlet, and a second end in fluid communication with the suction inlet, wherein the hot gas bypass valve defines at least a portion of the second passageway between the first and second ends of the second passageway.

17. The refrigeration unit of claim 16, wherein the controller is operable to open and close the hot gas bypass valve to adjust a flow rate of the pressurized, gaseous refrigerant through the second passageway.

18. The refrigeration unit of claim 17, wherein the controller is operable to modulate the hot gas bypass valve.

19. The refrigeration unit of claim 17, wherein the controller is operable to open and close the purge valve to adjust a flow rate of the liquid refrigerant through the first passageway.

20. The refrigeration unit of claim 19, further comprising a pressure sensor in fluid communication with the suction inlet to detect the pressure in the suction inlet.

21. The refrigeration unit of claim 20, wherein the controller is in communication with the pressure sensor to monitor the pressure in the suction inlet, and wherein the controller is operable to adjust at least one of the purge valve and the hot gas bypass valve in response to the monitored pressure in the suction inlet.

22. The refrigeration unit of claim 17, wherein the controller is operable to modulate the purge valve.

23. The refrigeration unit of claim 14, wherein the controller is configured to open the hot gas bypass valve when the pressure in the suction inlet is less than the predetermined limit.

24. The refrigeration unit of claim 14, further comprising a prime mover configured to drive the compressor.

25. The refrigeration unit of claim 24, wherein the prime mover includes one of an engine and an electric motor, wherein the electric motor and the engine are capable of producing the same power output.

26. The refrigeration unit of claim 25, wherein the purge valve and the hot gas bypass valve can only be in an open state when the electric motor is utilized to drive the compressor.

27. A refrigeration unit comprising:

a compressor including a suction inlet and a discharge outlet;

a condenser in fluid communication with the discharge outlet through which pressurized, gaseous refrigerant is condensed;

an evaporator in fluid communication with the condenser to receive liquid refrigerant from the condenser and return heated, gaseous refrigerant to the suction inlet;

a passageway having a first end in fluid communication with an outlet of the condenser, and a second end in fluid communication with the suction inlet, wherein the passageway directs liquid refrigerant directly from the outlet of the condenser to the suction inlet in a liquid phase;

a purge valve defining at least a portion of the passageway between the first and second ends, the purge valve operable to selectively divert the liquid refrigerant from the condenser to the suction inlet to increase a pressure in the suction inlet; and a controller configured to open the purge valve to deliver liquid refrigerant exiting the outlet of the condenser to the suction inlet in the liquid phase when the pressure in the suction inlet is less than a predetermined limit to increase the pressure in the suction inlet.

28. The refrigeration unit of claim 27, wherein the passageway is a first passageway, and wherein the refrigeration unit further includes:

a second passageway having a first end in fluid communication with the discharge outlet, and a second end in fluid communication with the suction inlet, and a hot gas bypass valve defining at least a portion of the second passageway between the first and second ends of the second passageway.

29. The refrigeration unit of claim 28, wherein the controller is configured to open the hot gas bypass valve when the pressure in the suction inlet is less than the predetermined limit.

30. The refrigeration unit of claim 27, wherein the controller is configured to modulate the purge valve by opening the purge valve for a set amount of time during a time cycle when the pressure in the suction inlet is less than the predetermined limit to increase the pressure in the suction inlet.

* * * * *